United States Patent [19]

Hardy et al.

[11] 4,401,302

[45] Aug. 30, 1983

[54] SHEET SEPARATION APPARATUS AND METHOD

[75] Inventors: Eugene C. Hardy, Boulder; Milan J. Miklos, Westminster, both of Colo.

[73] Assignee: International Business Machines Corporation, Armonk, N.Y.

[21] Appl. No.: 260,159

[22] Filed: May 4, 1981

[51] Int. Cl.[3] ..... B65H 9/06; B65H 29/58

[52] U.S. Cl. ..... 271/251; 271/314; 271/207; 271/253

[58] Field of Search ..... 271/250, 251, 234, 240, 271/314, 207, 253, 254, 255; 414/54

[56] References Cited

U.S. PATENT DOCUMENTS

| | | | |
|---|---|---|---|
| 1,366,938 | 2/1921 | Renz . | |
| 2,816,762 | 12/1957 | Donald | 271/86 |
| 2,839,295 | 6/1958 | Bernard, Jr. | 271/86 |
| 3,860,127 | 1/1975 | Fassman | 214/6 N |
| 3,994,487 | 11/1976 | Wicklund | 271/314 |
| 3,997,154 | 12/1976 | Mol | 271/215 |
| 4,017,066 | 4/1977 | Lasher | 271/251 |
| 4,162,786 | 7/1979 | Bullock | 271/64 |

FOREIGN PATENT DOCUMENTS

| | | | |
|---|---|---|---|
| 249882 | 3/1927 | United Kingdom . | |
| 1256289 | 12/1971 | United Kingdom | 271/80 |

OTHER PUBLICATIONS

IBM Technical Disclosure Bulletin Entitled "Aligning Device for Bi-Width Documents", by R. A. Billings, vol. 6, No. 6, 11/63, pp. 5-6.

IBM Technical Disclosure Bulletin Entitled "Sheet Aligner" by S. R. Harding and J. C. Rogers, vol. 18, No. 5, 10/75, pp. 1307-1308.

*Primary Examiner*—Robert B. Reeves
*Assistant Examiner*—James Barlow
*Attorney, Agent, or Firm*—Gunter A. Hauptman; Earl C. Hancock

[57] ABSTRACT

An information distributor has an entry tray for receiving document originals to be copied and also receives magnetic cards carrying indicia representing information to be reproduced. Copies emerge from a copying mechanism and enter an aligner which physically offsets selected sheets relative to nonselected sheets for stacking in a copy exit pocket. In the aligner, a fixed reference edge deflects incoming sheets along a reference line. A movable reference edge may be selectively lowered between the fixed reference edge and incoming sheets to deflect sheets along another line parallel to, but not coincident with, the reference line.

8 Claims, 5 Drawing Figures

SHEET SEPARATION APPARATUS AND METHOD

BACKGROUND OF THE INVENTION

1. Field of the Invention

The invention relates to printing and sorting indicia-carrying flexible sheets. More particularly, the invention relates to delivering printed sheets in offset stacks.

2. Description of the Prior Art

The IBM 6670 Information Distributor copies onto copy sheets indicia carried by original documents or magnetic cards. Successive documents or cards create a designated number of copies in either a copy exit pocket or a print exit pocket. During "copy" operation, copies of documents or cards accumulate in the copy exit pocket in the designated order and quantities. For example, ten copies of a second document stack onto ten copies of a first document. During "print" operation, the card indicia repeatedly generate copies in job sequence placing, for example, ten pairs of copies of documents one and two in the print exit pocket. Alternate jobs, each second pair of copies in the example, sit in the print exit pocket offset from its neighboring pair, facilitating operator removal and separation.

A job separator mechanism adjacent the print exit pocket of the IBM 6670 every sheet passing through it from a copy sheet aligner to the pocket. A job separator vane routes alternate jobs directly to the exit pocket without offset. Applicants' invention eliminates the job separator mechanism by off-setting the jobs in the sheet aligner.

In the IBM 6670 sheet aligner, rollers drive sheets from an entry, across an aligner plate, against a reference edge and then out an exit. Regardless of entry sheet orientation, all sheets exit aligned to a single reference edge.

The prior art shows metal-sheet staggering by selecting differently positioned stop plates against which sheets may stack. These devices do not address job separation by acting on one relatively flimsy, flexible sheet passing through an aligner to a separate stacking device. Separating jobs by moving stack stops creates movement and damage problems in stacks of light, thin material, like paper, not evident with metal sheets.

SUMMARY OF THE INVENTION

The invention eliminates special job separating mechanisms by offsetting sheets, one by one, as they pass through an aligner and then, stacking them in a physically distinct exit pocket. A sheet source provides one sheet at a time to the aligner entry, leading edge first. The aligner drives the sheet edge, adjacent the leading edge, of selected sheets against a first aligning edge and then out the entry to form a stack in the exit pocket. The aligner drives nonselected sheets against a second aligning edge, interposed between the first edge and the sheet, and then sends them to the stack offset relative to the selected sheets.

DESCRIPTION OF THE PREFERRED EMBODIMENT

Figure 1A:
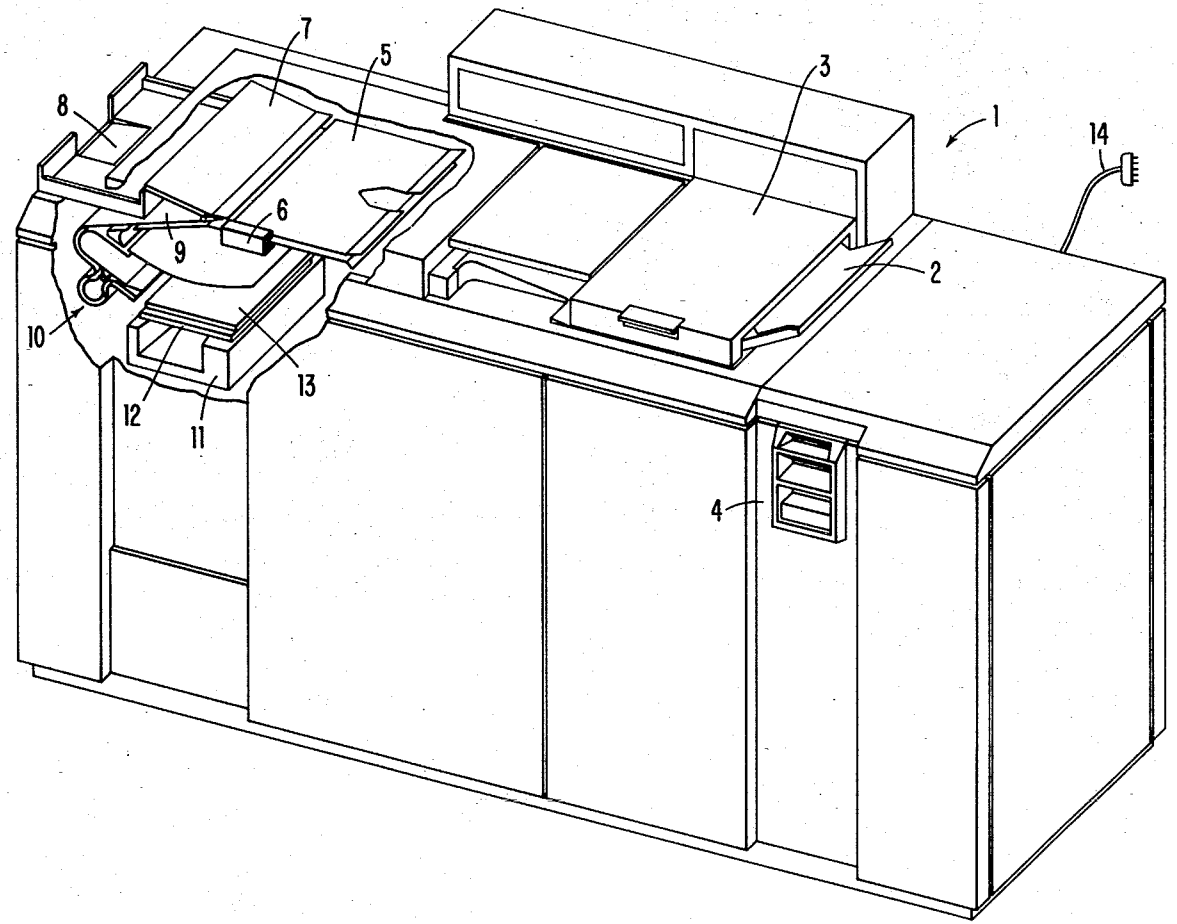
FIG. 1A PRIOR ART
FIGS. 1A and 1B show a prior art information distributor and job separator.

Referring to FIG. 1A, a prior art information distributor 1 having an entry tray 2 for receiving document originals to be copied, is shown. The IBM 6670 Information Distributor marketed by the International Business Machines Corporation, illustrating such a device is described in the IBM 6670 INFORMATION DISTRIBUTOR SERVICE MANUAL, January 1979, Form No. 241-6131-0, available from International Business Machines Corporation. Documents placed in the entry tray 2 are placed over a document glass covered by a document cover 3. Instead of entering original documents, it is alternatively possible to place magnetic cards into a magnetic card deck 4 for carrying indicia representing information to be produced by the information distributor 1. When copies are made, either from the originals placed in the entry tray 2 or magnetic cards placed into the magnetic card deck 4, copies emerge from the copying mechanism and enter an aligner 5 wherein they assume a reference physical position by striking a reference edge 6. Copy sheets emerging from the aligner 5 may take either one of two paths 7 or 9. If copies are merely to be stacked, they go by way of an upper exit path to a copy exit pocket 8. However, it is possible to send sheets by job to a print exit pocket 11 by way of lower exit path 9 which utilizes a job separator 10 to physically offset sheets associated with different jobs, for example, job 12 and job 13. Normally, when original sheets are entered into the entry tray 2, the copies made therefrom are stacked in the copy exit pocket 8. When magnetic cards are entered into the magnetic card deck 4, it is possible to utilize the information from the cards in a sequence which, in effect, collates the copies made and stacks them by job in the print exit pocket 11 as shown. For example, it is possible to make five copies of each of ten sheets of originals represented by magnetic card information and stack them into five separate jobs, each job alternatively offset from the adjacent job, with ten sheets in each stack. In a typical offset position, the forward offset portion of the paper stack 12 is distinguished from the backward offset portion of the paper stack 13. It is also possible to receive information from remote devices, instead of from magnetic cards entered into the magnetic card deck 4, by means of a remote communications cable 14.

Figure 1B:
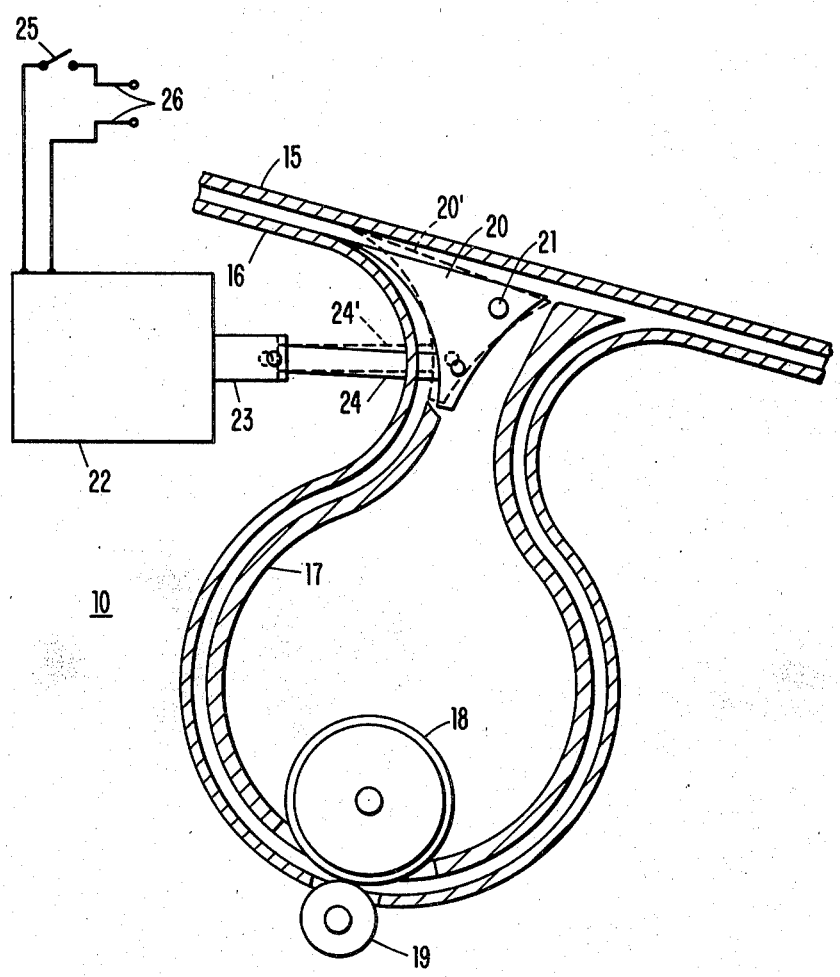
FIG. 1B PRIOR ART

The prior art job separator 10 is shown in greater detail in FIG. 1B. Sheets of paper enter the job separator 10 between the guide plate 15 and the outer wall 16. A gate 20 is pivoted around a pivot 21 to direct the paper either straight through the job separator 10 or into a curved path formed by the outer wall 16 and the inner wall 17. Sheets that travel straight through between the guide plate 15 and the outer wall 16 emerge into the print exit pocket in a backward offset position 13 whereas, sheets that travel through the job separator 10 in the path between the outer wall 16 and the inner wall 17 are offset forward to the position 12. The offset of sheets in the circular path between the outer wall 16 and the inner wall 17 is caused by their geometric design as is well known to one skilled in the art, which causes the paper to be skewed forward as it is driven by roller 18 and idler 19. Signals from job separation logic are applied to terminals 26 and contacts 25 to operate a solenoid coil 22 which, in turn, retracts plunger 23 attached to arm 24 to move gate 20 to position 20' when energized. Thus, sheets entering between guide plate 15 and outer plate 16 are diverted into the curved offsetting portion of the job separator 10 when the switch 25 is activated, and go straight through the job separator when the switch 25 is not activated.

Figure 2:
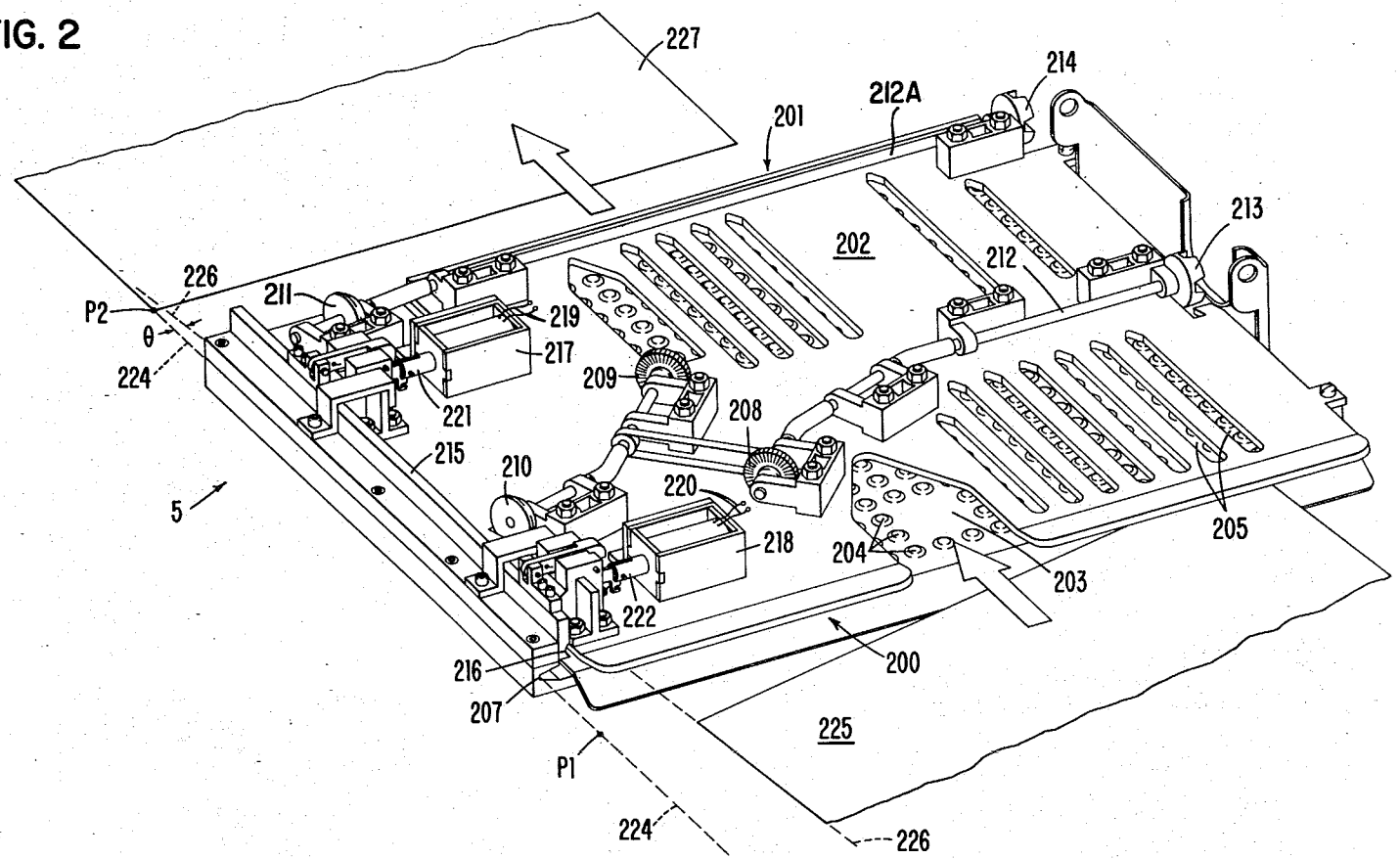
FIG. 2 shows an aligner incorporating the invention.

Referring to FIG. 2, there is shown a modified aligner, incorporating the invention herein which eliminates the job separator 10 of FIG. 1B and utilizes the switch closure information 25. The aligner 5 includes an entry 200 for receiving sheets of paper such as sheet 225 and an exit 201 for emiiter sheets of paper such as sheet 227. The entry 200 and exit 201 are defined by an upper plate 202 and a lower plate 203 carrying bubbles 204. The upper plate 202 has openings 205. The reference edge 6 has a first reference surface 207 against which incoming sheets 225 are driven by whiffle rollers 208 and 209. Conical rollers 210 and 211 drive the paper forward. Driven shafts 212 and 212A attached to the rollers 208 through 210 and roller 211, respectively, are driven by a mechanism, not shown, through drive clutches 213 and 214. A vertical travelling reference edge 215 may be lowered between the first reference surface and the incoming sheet 225 alignment line edge 226 to present a second reference surface 216 when solenoids 217 and 218 are activated by signals on lines 219 and 220 to drive plungers 221 and 222. Reference surfaces 207 and 216 contribute to the formation of stacks 12 and 13, respectively.

Figure 3A:
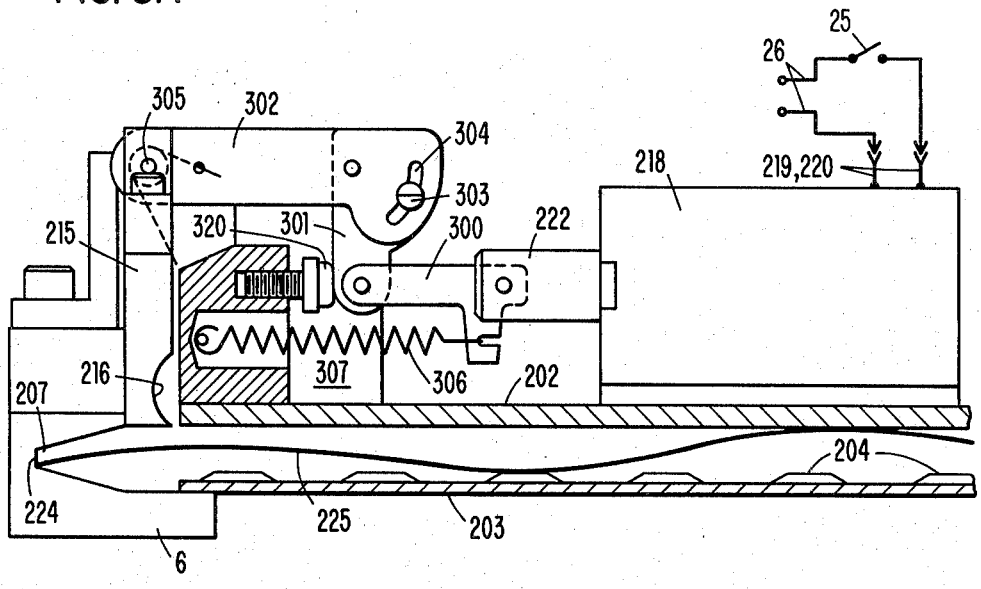
FIGS. 3A and 3B detail cross-section of the FIG. 2 aligner.
Figure 3B:
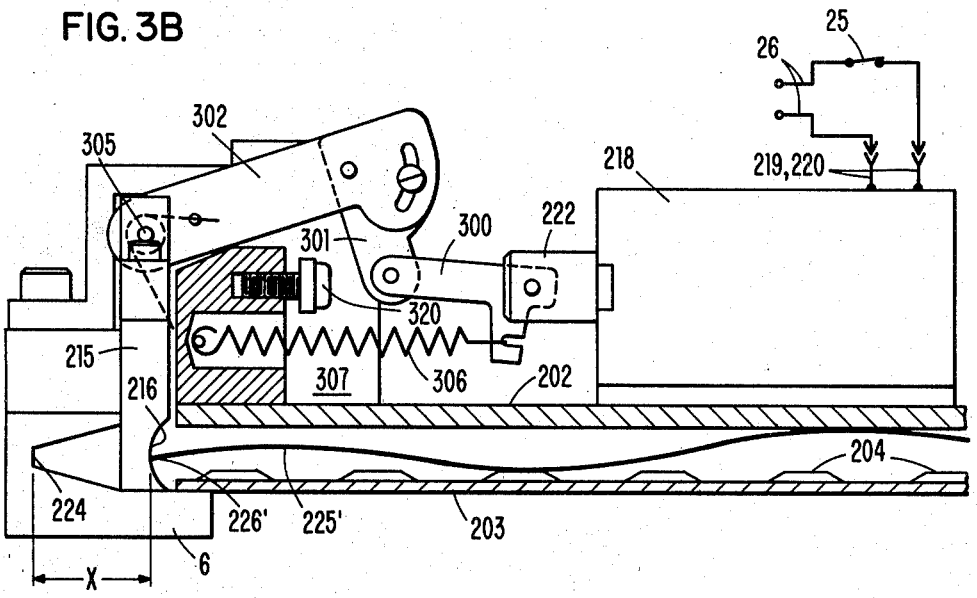

FIGS. 3A and 3B illustrate the operation of the solenoid 218 to lower the vertical travelling reference edge 215 in greater detail. Normally, when the switch 25 is open, the plunger 222 is in its extended, left-most, position causing the vertical travelling reference edge to be raised as shown in FIG. 3A. Thus, an incoming sheet of paper 225 is driven across the bubbles on the lower plate toward the reference edge 6, reference line 224, at the first reference surface 207. However, when the switch 25 is closed, a signal from terminals 26 are applied to terminals 219 and 220 of both the solenoids 217 and 218 to retract the plunger 222 which causes first linkage 300 and second linkage 301 to operate actuator 302 lowering the vertical travelling reference edge 215 downward as shown in FIG. 3B. There are provided an adjustment screw 303 and an adjustment slot 304 to permit accurate adjustment of the depth of feed of the vertical travelling reference edge 215 so that the second reference surface 216 is represented to the incoming sheet 225', edge 226', at approximately the same orientation as the first reference surface 207 of the reference edge 6. Thus, as the sheet 225' is driven leftward it contacts the surface 216 instead of the surface 207 and is offset by the difference between the line 224 and the edge 226' of the paper 225'. When the switch 25 reopens, the spring 306 extends the plunger 222 to again lift the vertical travelling reference edge 215 out of the paper path. The screw stop 320 functions as an adjustment for the upward, as shown in FIG. 3A, position of travelling reference edge 215.

Operation of the invention will now be described with reference to all of the figures. In FIG. 1A, it is assumed that the job separator 10 has been replaced by the aligner 5 incorporating the invention herein shown in FIG. 2. Magnetic cards carrying indicia to be reproduced, or electrical signals supplied from the remote communication cable, are placed into the magnetic card deck 4. If each magnetic card represents one copy to be made, and eacy copy is preceded by a job card indicating the number of copies in the job to be made, it is possible to supply to the information distributor 1 a request to perform a series of uninterrupted jobs which will generate a stack of papers in the print exit pocket 11. Assume for example, that five jobs are to be done, that is five different things are to be reproduced, and that there are to be ten copies of each. It will then be desirable to place into the print exit pocket, five stacks of documents each stack containing ten sheets of paper and each group of ten documents being offset relative to the adjacent set. For example, the first set appears as set 12 in FIG. 1A, the second set as set 13, the third set in the same position as set 12, etc. Referring to FIG. 3A, incoming sheet 225 represents each of the first ten sheets of paper if the vertical travelling reference edge 215 is in the position shown. In FIG. 3B, incoming sheet 225' represents the next ten sheets of paper if the travelling reference edge 215 is in the position shown. Initially, for the first ten sheets of paper 225, each sheet enters the aligner 5 at the entry 200 and is driven by the rollers 208 through 211 against the reference edge 6, first reference surface 207 which lies along a reference line 224. As each incoming sheet 225 edge 226 enters the entry 200, it does so at an angle theta formed by the reference line 224 and the incoming sheet edge 226. The rollers 208–211 force the edge 226 against the surface 207 to bring the lines 224 and 226 into coincidence and the angle to zero. After ten sheets, the switch 25 is closed energizing the solenoid 218 to lower the vertical travelling reference edge 216 to a position interposed between the reference line 224 and the incoming sheet 225' edge 226'. The rollers 208–211 then drive the incoming sheet 225' edge 226' against the second reference surface 216 of the vertical travelling reference edge 215 to bring the edge line 226' into parallel relationship with the reference line 224 but not coincident therewith. Thus, for the next ten incoming sheets 225', the outgoing sheets, which form stack 13, are offset by the distance X.

While the invention has been particularly shown and described with reference to preferred embodiments thereof, it will be understood by those skilled in the art that various changes in form and details may be made therein without departing from the spirit and scope of the invention.

What is claimed is:

1. In apparatus including means for printing indicia on flexible sheets, wherein there are provided:

a plurality of guiding means defining an opening, having an entry and an exit, an arbitrary reference line connecting a point at the entry with a point at the exit, for receiving at the entry sheets from the printing means having edges upredictably aligned with respect to the reference line;

driving means extending through at least one of the guiding means and, in the absence of a sheet, contacting another one of the guiding means, operable to drive sheets along a route from the entry toward the exit at an angle to the reference line;

an improvement for delivering the printed sheets in offset positions, comprising:

a first reference means, coincident with the reference line, for engaging one of the edges of sheets driven fronm the entry to the exit, and thereby aligning edges of these sheets with the line;

a second reference means, aligned relative to but not coincident with, the first reference line, operable to engage one of the edges of sheets driven from the entry to the exit; and means selectively operable for positioning one of said reference means in and out of intercepting relationship with the edges of sheets driven by the driving means;

whereby the edges of sheets engaged by the second reference means are aligned relative to, but not coincident with, the edges of sheets which engage the first reference means.

2. The improvement of claim 1, wherein the first reference means comprises a fixed member and the second reference means comprises a movable member parallel to the first reference means and interposable between the first reference means and the route along which sheets are driven in response to said selectively operable means.

3. The improvement of claim 2, wherein the movable members moves along a path intersecting a plane in which the reference line lies.

4. The improvement of claim 3 wherein the path is a straight line.

5. The improvement of claim 4 wherein the path is perpendicular to the plane.

6. The improvement of claim 5 wherein the path is vertical.

7. The improvement of claim 1, wherein said selectively operable means is is coupled for moving the second reference means in response to external control whereby sheets are selectively offset.

8. The improvement of claim 7 whereby the driving means comprise rollers and the guiding means include upper and lower plates.

* * * * *